US006478198B2

(12) United States Patent
Haroian

(10) Patent No.: US 6,478,198 B2
(45) Date of Patent: Nov. 12, 2002

(54) CONE-SHAPED AEROSOL CAN SPRAY NOZZLE

(76) Inventor: Andrew Haroian, 345 W. Karcher Ave., Nampa, ID (US) 83687

( * ) Notice: Subject to any disclaimer, the term of this patent is extended or adjusted under 35 U.S.C. 154(b) by 0 days.

(21) Appl. No.: 09/906,584

(22) Filed: Jul. 13, 2001

(65) Prior Publication Data

US 2002/0011500 A1 Jan. 31, 2002

Related U.S. Application Data

(60) Provisional application No. 60/218,645, filed on Jul. 14, 2000.

(51) Int. Cl.[7] ..... B65D 83/52

(52) U.S. Cl. ..... 222/402.1; 222/481.5; 239/311

(58) Field of Search ..... 222/402.1, 481.5, 222/484; 239/318, 310, 311, 428.5

(56) References Cited

U.S. PATENT DOCUMENTS

| | | | | | |
|---|---|---|---|---|---|
| 2,612,293 | A | * | 9/1952 | Michel | 222/182 |
| 3,191,809 | A | * | 6/1965 | Schultz et al. | 222/182 |
| 3,368,302 | A | * | 2/1968 | Martino | 46/90 |
| 3,495,922 | A | * | 2/1970 | Stenman | 401/190 |
| 3,841,532 | A | * | 10/1974 | Gores | 222/205 |
| 3,913,842 | A | * | 10/1975 | Singer | 239/337 |
| 3,920,165 | A | * | 11/1975 | Schultz | 222/402.23 |
| 4,226,340 | A | * | 10/1980 | Troesch | 222/183 |
| 4,239,407 | A | | 12/1980 | Knight | 401/190 |
| 4,420,099 | A | * | 12/1983 | Pizzurro et al. | 222/205 |
| 4,958,755 | A | * | 9/1990 | Gerstung | 222/402.23 |
| 5,037,001 | A | * | 8/1991 | Presant | 222/1 |
| 5,450,983 | A | * | 9/1995 | Stern et al. | 222/1 |
| 5,605,259 | A | * | 2/1997 | Clawson et al. | 222/402.23 |
| 5,711,484 | A | * | 1/1998 | Blette et al. | 239/104 |
| 5,725,155 | A | * | 3/1998 | Grunenberg et al. | 239/343 |
| 5,788,389 | A | * | 8/1998 | de Laforcade | 401/190 |

* cited by examiner

*Primary Examiner*—Lesley D. Morris
*Assistant Examiner*—Frederick C. Nicolas
(74) *Attorney, Agent, or Firm*—Ken J. Pedersen; Barbara S. Pedersen; Pedersen and Company, PLLC

(57) ABSTRACT

A cone-shaped nozzle for an aerosol spray can is disclosed. The nozzle preferably has a top end, or tip, and an opposing end, or stem, that removably connects to the can. Through the nozzle from the top center of the tip to the bottom center of the preferably cylindrical stem is a central cylindrical passageway. The top end of the passageway is the tip orifice, through which is discharged the contents of the can, and the bottom end of the passageway is the stem orifice, which receives the contents of the can for passage to the tip. The bottom of the stem and the stem orifice cooperate with the top of a release valve in the top of the aerosol can, so that the nozzle is supplied through the stem orifice. The stem is long enough to permit the cone-shaped nozzle to be depressed on its top, and travel downwardly far enough to activate the release valve. Optionally, there is an opening in the wall of the stem to permit the ingress of aspirating air into the central cylindrical passageway when the release valve is activated.

2 Claims, 3 Drawing Sheets

CONE-SHAPED AEROSOL CAN SPRAY NOZZLE

BACKGROUND OF THE INVENTION

This application claims priority from U.S. Provisional Patent Application Ser. No. 60/218,645, filed on Jul. 14, 2000, entitled "Cone-Shaped Aerosol Can Spray Nozzle" the disclosure of which is incorporated herein by this reference.

FIELD OF THE INVENTION.

This invention relates generally to aerosol spray cans, and more specifically to a cone-shaped nozzle for an aerosol spray can.

RELATED ART.

U.S. Pat. No. 4,239,407 (Knight) describes an aerosol spray can with several nozzles for application of the spray can contents into hard-to-reach places. This patent discloses a cone-shaped nozzle which discharges through orifices in its outer conical surface, but not through its tip. The release valve in this patent is activated by a push-button in the side of the can.

Still, there is a need for a simple and economical aerosol can spray nozzle which can also activate the release valve. This invention addresses this need.

SUMMARY OF THE INVENTION

This invention is a cone-shaped nozzle for an aerosol spray can. The nozzle discharges through an orifice in the tip of the cone. The tip orifice is the top of a cylindrical passageway near the center of the top of the cone. The central cylindrical passageway extends through the center of the cone. At or near the bottom of the cone is a cylindrical stem, through which the central cylindrical passageway also extends.

The nozzle is supplied through an orifice in the bottom of the stem. The stem orifice is the bottom of the central cylindrical passageway. The bottom of the stem and the stem orifice cooperate with the top of a release valve in the top of the aerosol can. The stem is long enough to permit the cone-shaped nozzle to be depressed on its top, and travel downwardly far enough to activate the release valve. Optionally, there is an opening in the wall of the stem to permit the ingress of aspirating air into the central cylindrical passageway when the release valve is activated.

DETAILED DESCRIPTION OF THE PREFERRED EMBODIMENT

Figure 1:
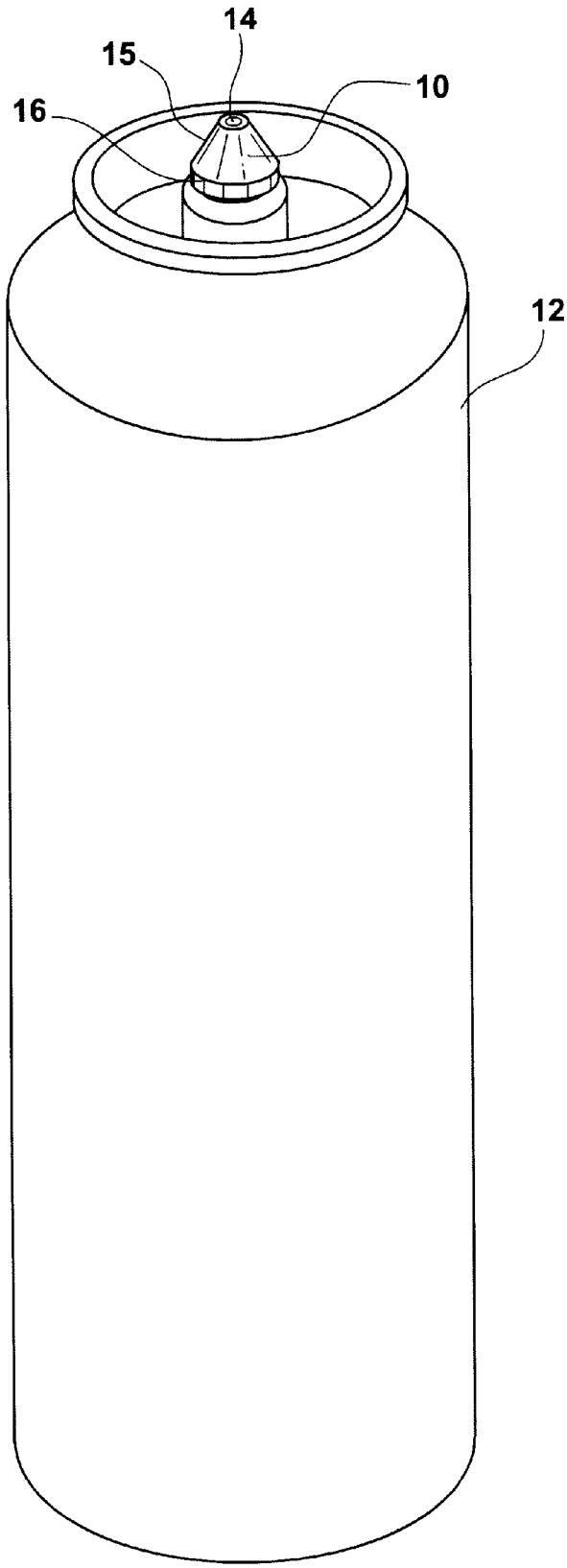
FIG. 1 is a top, side perspective view of one embodiment of the invention mounted on the top of an aerosol can.
Figure 2:
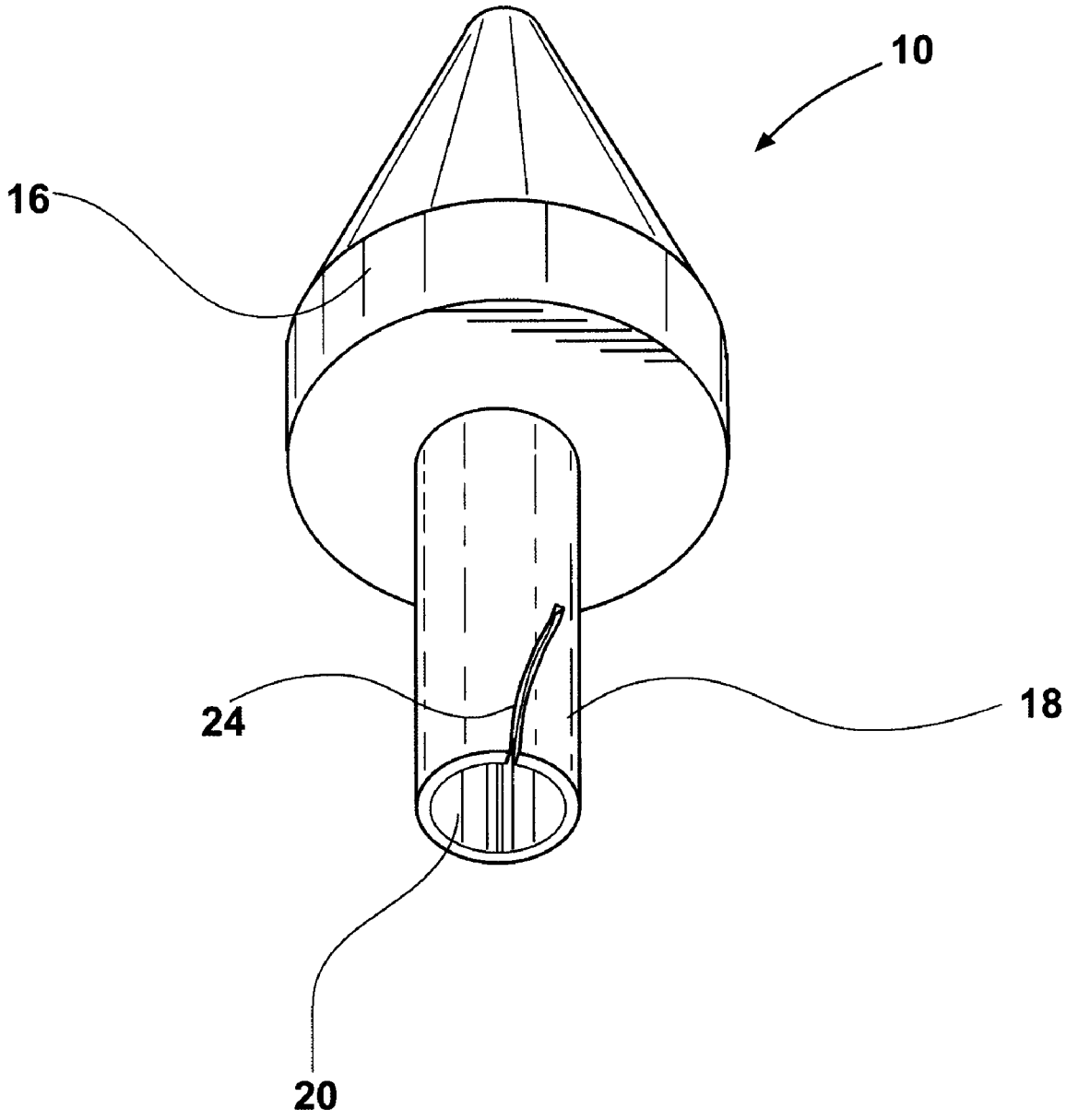
FIG. 2 is a bottom side perspective view of the embodiment of the invention depicted in FIG. 1, but without the spray can.
Figure 3:
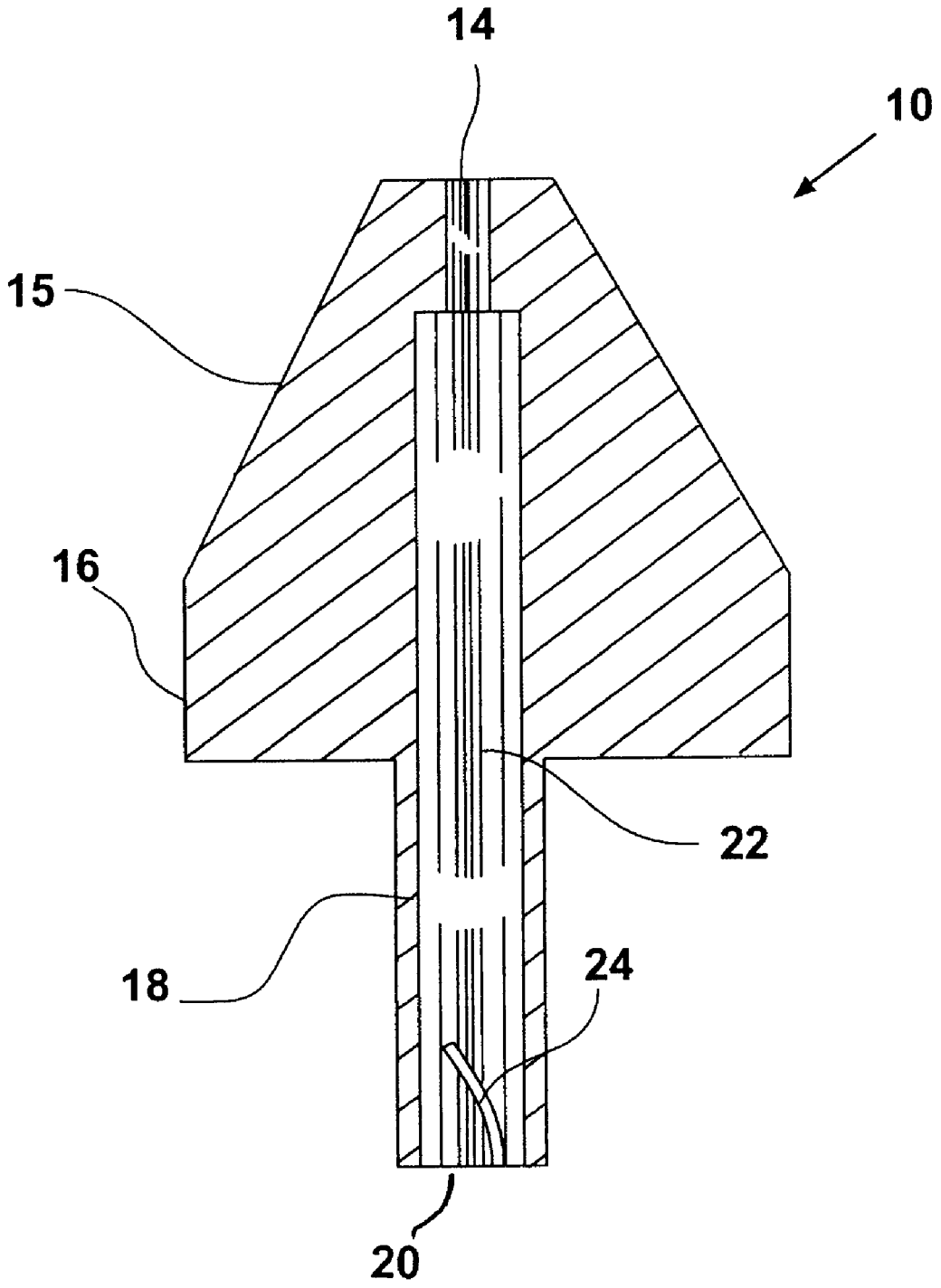
FIG. 3 is a side, cross-sectional view of the embodiment of the invention depicted in FIGS. 1 and 2.

Referring to the Figures, there is depicted one, but not all, of the embodiments of the invention. Conical nozzle 10 is mounted on the top of aerosol spray can 12. Nozzle 10 has a tip orifice 14 in its tip, a conical section 15 and a cylindrical base 16. Can 12 has a release valve (not shown) in its top. Typically, the release valve is centrally located and activated by downward pressure on its top.

The top of the release valve cooperates with a cylindrical stem 18 at the bottom of cylindrical base 16 of nozzle 10. Stem 18 has an orifice 20 at its bottom. Stem orifice 20 is the bottom of a central cylindrical passageway 22, which extends from the bottom to the top of nozzle 10. The top of central cylindrical passageway 22 is tip orifice 14. Preferably, stem 18 has an opening 24 in its side wall to permit the ingress of aspirating air into the cylindrical passageway when the release valve is activated.

Conical nozzle 10 may be any convenient size. Smaller, finer nozzles 10 will be more appropriate for supplying the aerosol can contents to smaller spaces, and vice-versa. Preferably, nozzle 10 is cone-shaped, but other, tapering shapes will also do. For example, instead of rounded sides, nozzle 10 may also have squared-off, but tapering sides, as long as the top of the nozzle terminates in a fine or pointed tip. Cylindrical base 16 is optional, but when it is present, it may be rounded or squared-off also.

Nozzle 10 may be made of any suitable material, including metal or plastic, and may be made by any conventional technique, including machining, forging, stamping or molding.

Aerosol spray can 12 may be any conventional spray can with a gas propellant and liquid contents for dispensing. Preferably, spray can 12 has a release valve in its top which is activated by downward pressure on nozzle 10. When the release valve is activated, propellant gas and liquid contents of the spray can are released. However, the valve arrangement described in U.S. Pat. No. 4,239,407 (Knight) discussed above would also be compatible with conical nozzle 10, provided the bottom of stem 18 of nozzle 10 is adapted, for example, by threading to become secured to the discharge line extending upwardly from the valve in this patent.

Preferably, spray can 12 is an aerosol can containing a light, low viscosity lubricant and a light propellant gas, like hexane, for example. This way, spray can 12 and nozzle 10 may be used to effectively dispense the lubricant to a specific, small area. For example, nozzle 10 may conveniently be inserted into the small lubricant hole opening in the nose of a chain saw sprocket. This way, when nozzle 10 is depressed, the release valve is activated, and the pressurized contents of the spray can 12, namely lubricant and hexane, are discharged from the top of the release valve. This way, the new lubricant sprayed into the hole can clean out the old lubricant and other debris on the surface to be lubricated, blasting it away. Then, the excess hexane propellant will evaporate quickly, leaving a cleaner and freshly-lubricated surface. Therefore, this apparatus and technique have advantages over the prior art pumping liquid-lubricant-only technique. A friction fit is preferably established between the bottom of stem 18 and the top of the release valve. This way, the discharged contents exiting through the valve are directed through stem orifice 20 into central cylindrical passageway 22, up through the center of nozzle 10, and out tip orifice 14. Preferably, additional aspiration air is admitted into passageway 22 through opening 24 in the side wall of stem 18. This way, a more turbulent mixing of the can 12 contents is effected, for ultimately better distribution of the lubricant.

The friction fit between the bottom of stem 18 and the top of the release valve also permits convenient change-out of the nozzle 10 to prevent accidental discharge of the can's contents, or to permit the installation instead of a different size or type nozzle, for example.

Tip orifice 14 may be any effective size of shape. Preferably, tip orifice 14 is a flat circle. However, a slanted oval, or a slot, or a plurality or combination of any of these orifices may be used. Tip orifice 14 may be the same diameter as central cylindrical passageway 22, or of different diameter. Additional aspirators and/or diffusers may be included in orifice tip 14.

Conical section 15 may have any effective angle of taper. Shorter, blunter conical sections 15 may be more appropriate for tighter spaces, while longer, sharper conical sections may be more appropriate when there is more room for the user to work in.

Stem 18 has an outer diameter substantially less than the diameter of the bottom of conical section 15 or cylindrical base 16. Stem 18 must be long enough to not interfere with the top of spray can 12 or the release valve during activation of the valve. Therefore, stem 18 must be at least as long as the downward travel or movement during activation of the valve. The bottom of stem 18 is adapted to cooperate with the top of the release valve.

Stem orifice 20 is the bottom of central cylindrical passageway 22, and orifice 20 may be the same diameter as passageway 22, or different. Stem orifice 20 is also adapted to cooperate with the discharge at the top of the release valve.

Opening 24 in the side wall of stem 18 for allowing aspirating air to enter central cylindrical passageway 22 when the release valve is activated. Therefore, opening 24 must exist on a location on the side wall of stem 18 where air can flow into passageway 22 when the release valve is activated, at least the distance up from the bottom of stem 18 greater than the travel during activation of the valve.

I claim:

1. An aerosol can spray nozzle for cooperating with a release valve in the top of an aerosol can, comprising:

a cone-shaped tip with a top and a bottom;

a tip orifice at the center of the top of the tip;

a stem on the bottom of the tip, said stem having a wall with an outer diameter and a bottom, the outer diameter of said stem wall being substantially less than the diameter of said cone-shaped tip;

a stem orifice near the bottom of the stem so that the bottom of the stem and the stem orifice may cooperate with a release valve in the top of the aerosol can; and a passageway extending through the center of the tip, from the tip orifice at the center of the top, to the stem orifice near the bottom of the stem.

2. The nozzle of claim 1 wherein there is an opening in the wall of the stem to permit the ingress of aspirating air into the passageway when the release valve is actuated.

* * * * *